US011299917B2

(12) United States Patent
Taga

(10) Patent No.: US 11,299,917 B2
(45) Date of Patent: Apr. 12, 2022

(54) VEHICLE DOOR LATCH DEVICE

(71) Applicant: MITSUI KINZOKU ACT CORPORATION, Yokohama (JP)

(72) Inventor: Takao Taga, Yokohama (JP)

(73) Assignee: MITSUI KINZOKU ACT CORPORATION, Yokohama (JP)

( * ) Notice: Subject to any disclaimer, the term of this patent is extended or adjusted under 35 U.S.C. 154(b) by 1029 days.

(21) Appl. No.: 15/950,697

(22) Filed: Apr. 11, 2018

(65) Prior Publication Data

US 2018/0313119 A1 Nov. 1, 2018

(30) Foreign Application Priority Data

Apr. 29, 2017 (JP) ..... JP2017-090884

(51) Int. Cl.
*E05B 77/26* (2014.01)
*E05B 15/04* (2006.01)

(52) U.S. Cl.
CPC .... *E05B 77/265* (2013.01); *E05B 2015/0493* (2013.01)

(58) Field of Classification Search
CPC ..... E05B 77/265; E05B 2015/0493; E05B 15/04; E05B 79/10; E05B 83/36
See application file for complete search history.

(56) References Cited

U.S. PATENT DOCUMENTS 6,406,073 B1 * 6/2002 Watanabe ..... E05B 77/265 292/216
8,006,583 B2 8/2011 Yoda

FOREIGN PATENT DOCUMENTS

FR 2780526 * 6/1998 ..... E05B 15/00
JP 2004-176415 A 6/2004
JP 2008-014094 A 1/2008
JP 2009-046908 A 3/2009
JP 2011-190605 A 9/2011

* cited by examiner

*Primary Examiner* — Christine M Mills
*Assistant Examiner* — Thomas L Neubauer
(74) *Attorney, Agent, or Firm* — Knobbe, Martens, Olson & Bear, LLP

(57) ABSTRACT

An over-center spring of a vehicle door latch device has a coil part that is loosely inserted on a spring support shaft, and a base end side spring leg part. A leading end side spring leg part elastically holds an abutting pin and is paired with the base end side spring leg part. A lock lever is provided with a slot through which the spring support shaft passes. The lock lever and the spring support shaft are disposed to be superposed on each other in an axial direction of the spring support shaft.

3 Claims, 6 Drawing Sheets

VEHICLE DOOR LATCH DEVICE

RELATED APPLICATION

The present application claims priority under 35 U.S.C. 119(a)-(d) to Japanese Patent Application No. 2017-090884, the entire contents of which are hereby incorporated by reference.

TECHNICAL FIELD

The present disclosure relates to a vehicle door latch device, and particularly to an over-center spring that urges a lock lever of a door latch device.

BACKGROUND ART

Conventional well-known vehicle door latch devices include a lock lever that is switched between a lock position and an unlock position, and the lock lever is elastically held on any one side of the lock position and the unlock position with a spring dead point as a boundary by elastic force of the over-center spring.

In the conventional over-center spring, a torsion coil spring is used. A functional structure of the over-center spring is classified into two types based on the shape of the spring.

The first one is a structure in which respective engaging end parts extending parallel to the axial direction of a coil part are formed on both ends of the coil part of a torsion coil spring, one of the engaging end parts being engaged with a lock lever, and the other bent end part being engaged with a base member such as a latch body (refer to reference numeral 34 of FIG. 1 in JP2004-176415A).

The second is a configuration in which respective spring leg parts extending in the tangential direction of a coil part (synonymous with the radial direction in the sense of the direction away from the coil part) are formed on both ends of the coil part of a torsion coil spring, a pair of spring leg parts being made to abut against a lock lever, and the coil part being loosely supported by a spring support shaft of a base member such as a latch body (refer to JP2008-014094A and JP2009-046908A). In this configuration, when the lock lever is in the middle between the lock position and the unlock position, spring elastic force becomes maximum, and the lock lever is elastically held at any one of the lock position and the unlock position with this position (spring dead point) as a boundary.

[Patent Literature 4] JP2011-190605A

The spring structure of JP2004-176415A has problems in which the intensity of the spring elastic force at the time of rotation displacement of the lock lever is not stable, assembling and fitting the spring is difficult, smooth rotation of the lock lever is compromised because of strong action that is caused by unnecessary spring pressure along the axial direction of the coil part on the lock lever, and the like.

On the other hand, the spring structures of JP2008-014094A and JP2009-046908A can satisfactorily overcome the above problems. However, in each of these spring structures, as regards the spring leg parts, interference of the long spring leg parts with other parts needs to be avoided since the spring leg parts extend long in the radial direction of the coil part, and a dead space is likely to be generated. Additionally, the coil part is merely loosely wound around the spring support shaft, and therefore the coil part is axially deviates with respect to the spring support shaft due to vehicle vibration or the like, and an ease of stable switching operation of the lock lever is sometimes impaired.

SUMMARY OF INVENTION

A first aspect of the present disclosure is a vehicle door latch device including: a lock lever that is pivotably secured to a housing case with a lock shaft; an abutting pin that is provided in the lock lever; a spring support shaft that is provided in the housing case; and an over-center spring having a coil part that is loosely inserted on the spring support shaft, and a base end side spring leg part and a leading end side spring leg part that extend in a direction away from the coil part, elastically hold the abutting pin therebetween, and are paired, wherein the lock lever is provided with a slot through which the spring support shaft passes, and the lock lever and the spring support shaft are disposed to be superposed on each other in an axial direction of the spring support shaft.

A second aspect of the present disclosure is a vehicle door latch device including: a lock lever that is pivotably secured to a housing case with a lock shaft; an abutting pin that is provided in the lock lever; a spring support shaft that is provided in the housing case; and an over-center spring having a coil part that is loosely inserted on the spring support shaft, and a base end side spring leg part and a leading end side spring leg part that extend in a direction away from the coil part, elastically hold the abutting pin therebetween, and are paired, wherein the spring support shaft is provided with a spring abutting rib that is brought into abutment against the base end side of the coil part to thereby restrict movement toward a base end side of the coil part, and the abutting pin is provided with a locking flange that is brought into abutment against the leading end side spring leg part extending from a leading end side of the coil part to thereby restrict movement of the leading end side spring leg part in a leading end side direction of the coil part.

According to a third aspect of the present disclosure, in the vehicle door latch device according to the second aspect, the lock lever is provided with a projection that faces the base end side spring leg part extending from the base end side of the coil part, and a leading end of the projection is located on a front side with respect to a leading end of the at least one spring abutting rib.

According to a fourth aspect of the present disclosure, in the vehicle door latch device according to the second aspect, the lock lever is provided with a slot through which the spring support shaft passes, and the lock lever and the spring support shaft are disposed to be superposed on each other in an axial direction of the spring support shaft.

According to a fifth aspect of the present disclosure, in the vehicle door latch device according to the second aspect, the spring abutting ribs are paired, and are formed at an interval in a circumferential direction of the spring support shaft.

According to a sixth aspect of the present disclosure, in the vehicle door latch device according to the third aspect, the lock lever is provided with a slot through which the spring support shaft passes, and the lock lever and the spring support shaft are disposed to be superposed on each other in an axial direction of the spring support shaft.

According to a seventh aspect of the present disclosure, in the vehicle door latch device according to any one aspect of the first, fourth and sixth aspects, the slot is formed in an arc shape with the lock shaft as a center.

According to an eighth aspect of the present disclosure, in the vehicle door latch device according to any one aspect of the first to sixth aspects, a child lever that is switched between a childproof set position and a childproof unset position is pivotably secured to the lock shaft.

According to the first to fourth aspects of the present disclosure, the lock lever and the spring support shaft can be disposed to be superposed on each other, and therefore rational design is attained, and space saving is attained. This superposed arrangement also allows a pair of the spring leg parts of the over-center spring to be superposed, providing further space saving. Additionally, the mounting position of the over-center spring is improved, and ease of operation is improved.

According to the second and fifth aspects of the present disclosure, in the over-center spring, the base end side in the axial direction of the coil part is positioned by the spring abutting rib, and the leading end side is positioned by the locking flange, and therefore chattering or backlash in the axial direction of the coil part can be satisfactorily reduced.

According to the third to sixth aspects of the present disclosure, movement of the base end side spring leg part to the base end side in the axial direction of the coil part is supported, and a place where the base end side spring leg part abuts against the lock lever is limited, and therefore it is possible to prevent the intensity of spring elastic force of the over-center spring from becoming unstable.

According to the seventh aspect of the present disclosure, the size of the slot formed in the lock lever can be reduced, and maintenance of the strength of the lock lever can be easily expected.

According to the eighth aspect of the present disclosure, the lock lever and the child lever can be supported by the common shaft, and therefore a rational design is realized.

DESCRIPTION OF EMBODIMENTS

Figure 1:
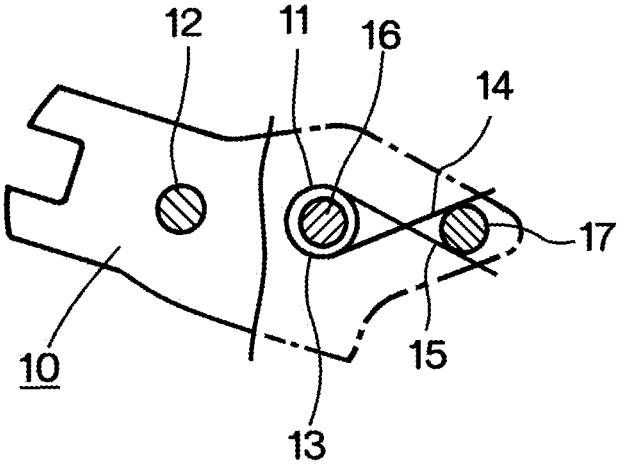
FIG. 1 is a schematic diagram illustrating the functional relation between a lock lever and an over-center spring of a door latch device according to the present disclosure.

An embodiment of a vehicle door latch device according to the present disclosure will be described with reference to the drawings. First, FIG. 1 and FIG. 2 each are a schematic diagram functionally illustrating the relation between lock lever 10 and over-center spring 11 of the vehicle door latch device. Lock lever 10 is pivotably secured to the base member or the like of the door latch device by lock shaft 12, and is switched between the lock position and the unlock position as is well known.

Over-center spring 11 includes coil part 13 located at the center, and a pair of spring leg parts 14, 15 extending in the tangential direction from respective both end parts of coil part 13. Into coil part 13, a pin-shaped spring support shaft 16 provided in the base member or the like is loosely inserted. Spring leg parts 14, 15 only need to extend in the radial direction of coil part 13, and are not limited to such a mode as to be apart from the tangential direction of coil part 13.

Spring leg parts 14, 15 have respective leading ends that are made to abut against abutting pin 17 provided in lock lever 10 from both sides, and hold abutting pin 17 therebetween with spring elastic force. The respective axial directions of lock shaft 12, spring support shaft 16, and abutting pin 17 are preferably parallel to each other. When lock shaft 12, spring support shaft 16, and abutting pin 17 are aligned, compression of over-center spring 11 is maximized. This position becomes a spring dead point, and lock lever 10 is elastically held on any one side of the lock position and the unlock position with the spring dead point as a boundary.

In the relation between lock lever 10 and over-center spring 11 thus disposed, long spring leg parts 14, 15 are disposed to be superposed on lock lever 10. Therefore, a dead space in the radial direction of lock shaft 12 is reduced.

In FIG. 1, spring support shaft 16 is disposed between lock shaft 12 and abutting pin 17. However, even when abutting pin 17 is disposed between lock shaft 12 and spring support shaft 16, the function of over-center spring 11 is established.

Figure 2:
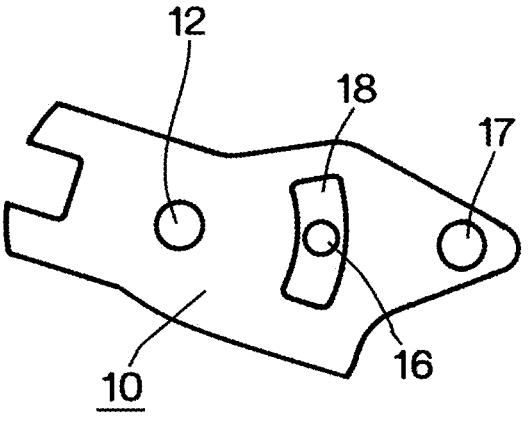
FIG. 2 is a schematic diagram illustrating an arc slot of the lock lever.

In FIG. 1, spring support shaft 16 is disposed at such a position as to be superposed on a rotating locus of lock lever 10, and therefore the space in the radial direction of lock shaft 12 is saved. In a case where spring support shaft 16 provided in the base member cannot be formed to be short, spring support shaft 16 sometimes interferes with the rotation of lock lever 10. However, in such a case, as illustrated in FIG. 2, slot 18 through which spring support shaft 16 can pass is provided in lock lever 10, so that it is possible to avoid such interference. In addition, the strength of lock lever 10 is easily maintained, and reduction in the weight of lock lever 10 is attained. Slot 18 is preferably formed in an arc shape with lock shaft 12 as the center.

Figure 3:
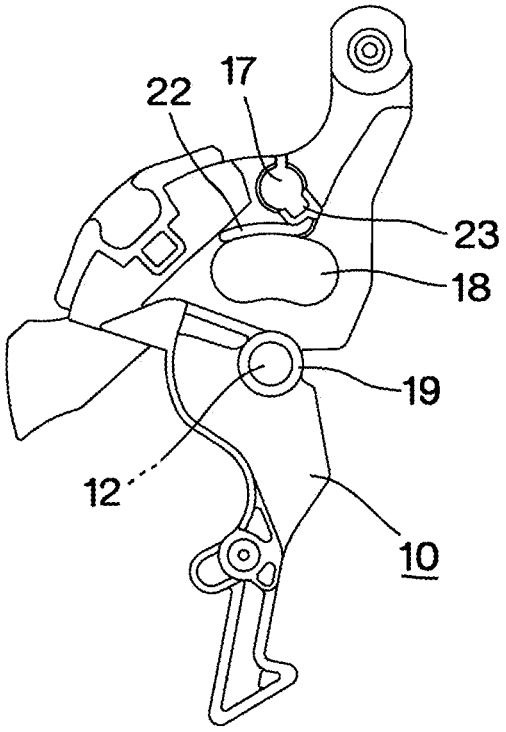
FIG. 3 is a detailed side view of the lock lever.
Figure 4:
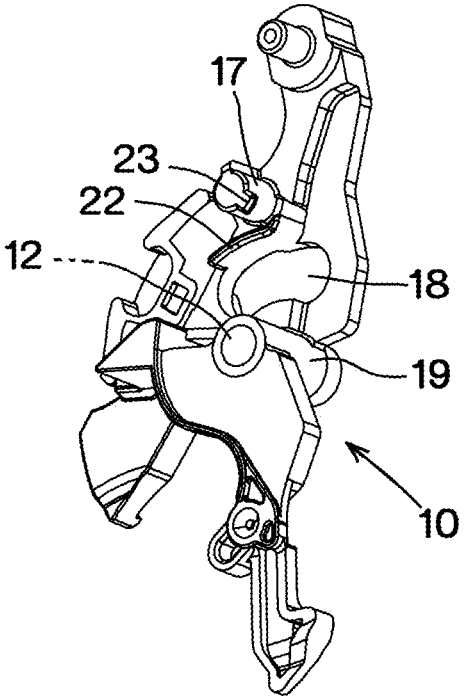
FIG. 4 is a detailed perspective view of the lock lever.

As the specific shape of lock lever 10 is sufficiently illustrated in FIG. 3 and FIG. 4, lock lever 10 is formed in a complicated shape in implementation of the vehicle door latch device. However, this is due to relation with other member or other mechanism. As illustrated in FIG. 4, lock lever 10 has a moderate thickness as a whole, and this is because of the length of shaft tube 19 into which lock shaft 12 is inserted. A lever part has an appropriate thickness.

Figure 5:
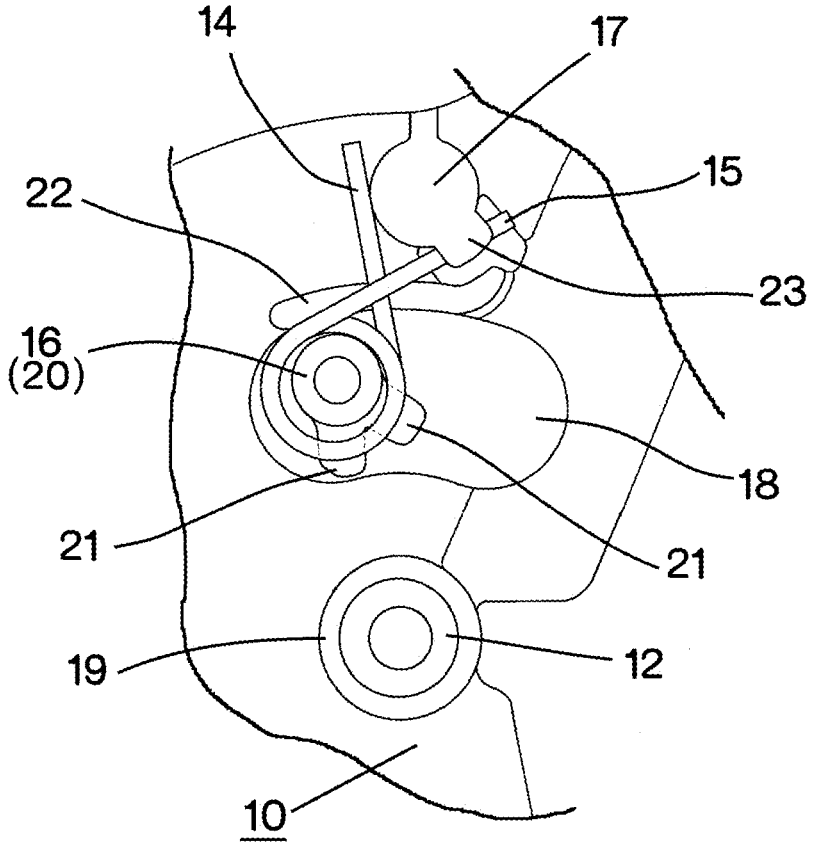
FIG. 5 is a partially enlarged view illustrating the lock lever and the over-center spring.
Figure 6:
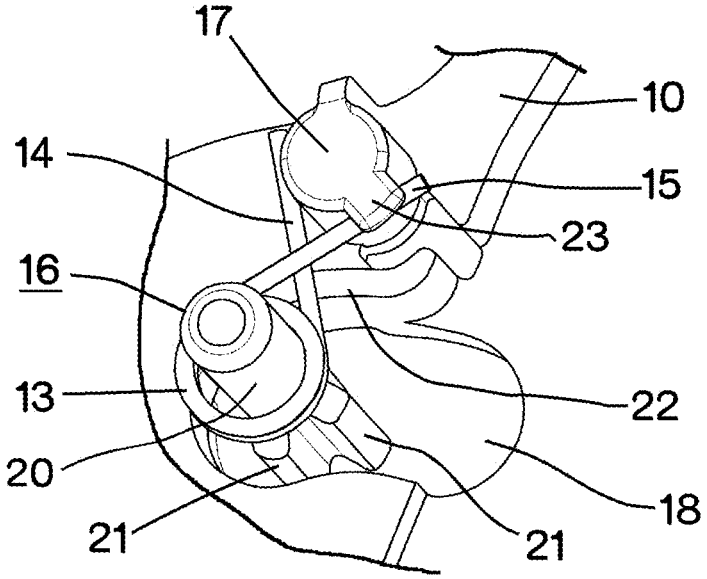
FIG. 6 is a partially enlarged perspective view illustrating the lock lever and the over-center spring.
Figure 7:
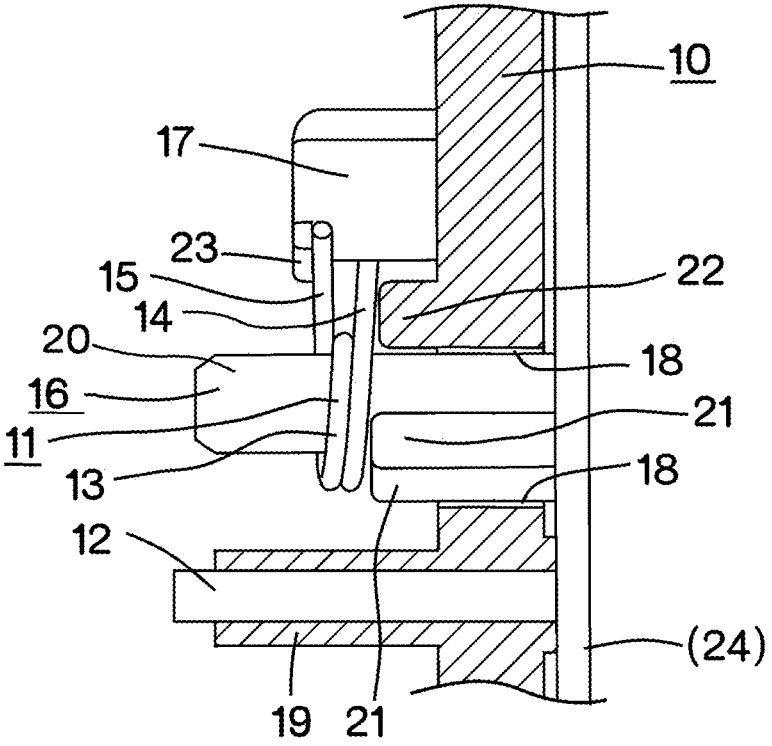
FIG. 7 is a partially sectional view illustrating the lock lever and the over-center spring.

As illustrated in FIG. 5 to FIG. 7, spring support shaft 16 is inserted into slot 18 of lock lever 10, and coil part 13 of over-center spring 11 is loosely wound around protruding end 20 of spring support shaft 16. In this embodiment, over-center spring 11 is disposed on one surface side (spring mounting surface side) of the lever part of lock lever 10.

On a base end part side of spring support shaft 16, spring abutting ribs 21 that are radially enlarged are formed. Movement in the base end part direction (mounting direction) of coil part 13 is restricted by abutment against spring abutting ribs 21, and positioning in the base end part direction (mounting direction) of coil part 13 is performed.

Spring abutting ribs 21 are preferably formed integrally with the base member provided with spring support shaft 16 and lock shaft 12. However, the total diameter of spring support shaft 16 and spring abutting ribs 21 only needs to be such a length as to reliably abut against coil part 13. Therefore, spring abutting ribs 21 can be formed on an outer circumference of the base end part of spring support shaft 16 so as to have a flange shape. However, in this case, a disadvantage occurs in which the weight is increased. Additionally, when the size of spring abutting ribs 21 increases, distortion is likely to be generated on an outer surface during the cooling process after integral resin molding with spring support shaft 16 and the base member. Therefore, in this embodiment, a pair of spring abutting ribs 21 is formed at an interval of about 55 degrees in the circumferential direction of spring support shaft 16. Consequently, in the axial direction of spring support shaft 16 (protruding end 20), coil part 13 can be reliably made to abut against spring abutting ribs 21, balance with reduction in weight can be satisfactorily attained, and distortion in the cooling process can be reduced.

One spring leg part 14 of over-center spring 11 is located on a side closer to the lever part of lock lever 10, and the other spring leg part 15 is located on a side apart from the lever part. As described above, the movement in the mounting direction (base end part direction) along the axis of coil part 13 is restricted and positioned by abutment of coil part 13 against spring abutting ribs 21. Therefore, spring leg part 14 generally does not need to be made to abut against the spring mounting surface side of lever part of lock lever 10 (naturally of cause, it needs to be made to abut against abutting pin 17), and unnecessary friction between spring leg part 14 and the spring mounting surface of the lever part should be avoided.

However, spring leg part 14 extends relatively long, and therefore in a case where spring leg part 14 is swung or deviates in the mounting direction (base end part direction) due to vehicle vibration or the like, it is not preferable that spring leg part 14 directly abut against the spring mounting surface of the lever part. In this embodiment, elongated projection 22 that is engaged in the detaching direction (leading end part direction) opposite to the mounting direction (base end part direction) is integrally formed on an edge of slot 18 of lock lever 10. Therefore, in a case where spring leg part 14 is swung or deviates in the mounting direction (base end part direction), projection 22 receives spring leg part 14, a change in the amount of the elastic force intensity of over-center spring 11 is reduced, and stabilized. For this purpose, projection 22 is shorter on the base end part side than spring abutting ribs 21, that is, spring abutting ribs 21 protrude in the detaching direction (leading end part direction) with respect to projection 22. Projection 22 is preferably an arc with lock shaft 12 as the center.

A leading end of the other spring leg part 15 of over-center spring 11 is made to abut against abutting pin 17, and is locked to locking flange 23 formed in abutting pin 17. Locking flange 23 protrudes in the radial direction from a leading end of abutting pin 17, and is brought into engagement with spring leg part 15 to thereby restrict movement in the detaching direction (leading end part direction) of coil part 13 and position coil part 13 in the detaching direction (leading end part direction). Additionally, locking flange 23 also has a disengagement preventive function for spring leg part 15.

Thus, in coil part 13 of over-center spring 11, the base end part side is positioned by abutment against spring abutting ribs 21, the leading end part side is positioned by abutment against locking flange 23, and backlash due to vehicle vibration or the like is satisfactorily reduced.

Over-center spring 11 can be assembled only by inserting coil part 13 on spring support shaft 16 formed in the base member or the like, and elastically engaging spring leg part 15 with locking flange 23 of abutting pin 17, and therefore is suitable for assembly by an automated machine.

Figure 8:
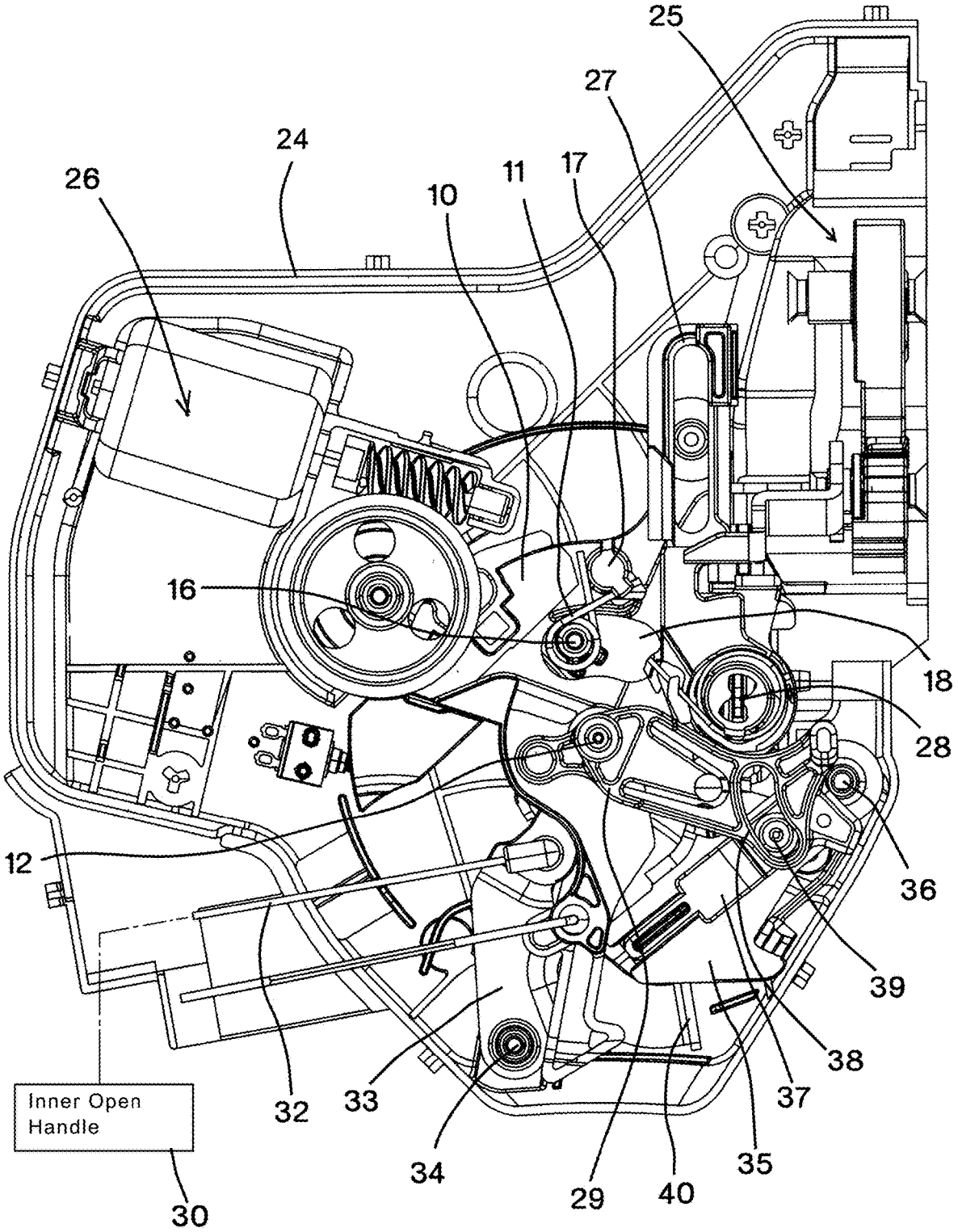
FIG. 8 is a side view of an indoor side of a mechanism part of the vehicle door latch device.

FIG. 8 illustrates an indoor side surface of a mechanism part of the vehicle door latch device. Various mechanisms of the door latch device are the aggregation of a plurality of levers and the like, and most of these are not directly related to the scope of this application, and therefore will be simply described.

In FIG. 8, well-known latch unit 25 is disposed at a right upper part of housing case 24 serving as a base member, lock lever 10 is pivotably secured to a substantial center of housing case 24 by lock shaft 12. On the left of housing case 24, actuator 26 that switches lock lever 10 between the lock position and the unlock position is stored.

Open link 27 that extends vertically is disposed on the slight right side of lock lever 10, and a lower end of open link 27 is locked to a leading end of outer lever 28. When outer lever 28 is rotated by door opening operation of an outer open handle (not illustrated) connected to the other end of outer lever 28, open link 27 moves upward, so that latch unit 25 is released. However, when lock lever 10 moves to the lock position, open link 27 is inclined to the left to be brought into a lock state, and latch unit 25 is not released.

Figure 9:
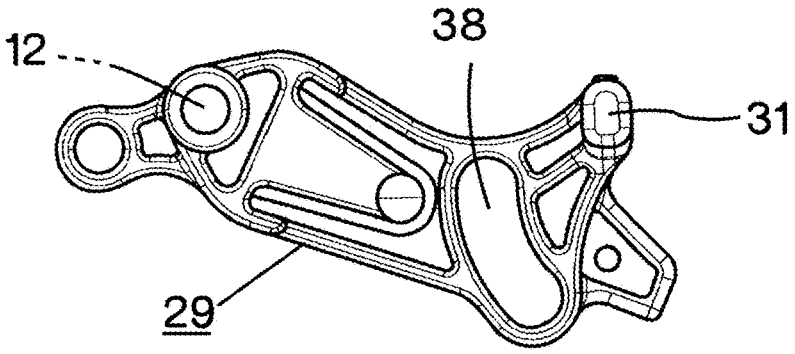
FIG. 9 is a side view of a child lever.

The above is brief description of the vehicle door latch device. In this embodiment, there is an improved point that child lever 29 (refer to FIG. 9) is pivotably secured to lock shaft 12 that supports lock lever 10, and therefore this point will be hereinafter described additionally.

Child lever 29 serves as an operation lever for a childproof mechanism that prevents the door of a back seat from being opened by operation of inner open handle 30. Operation knob 31 that is exposed to the outside through the opening of a door panel is provided on a turning end of child lever 29.

Figure 10:
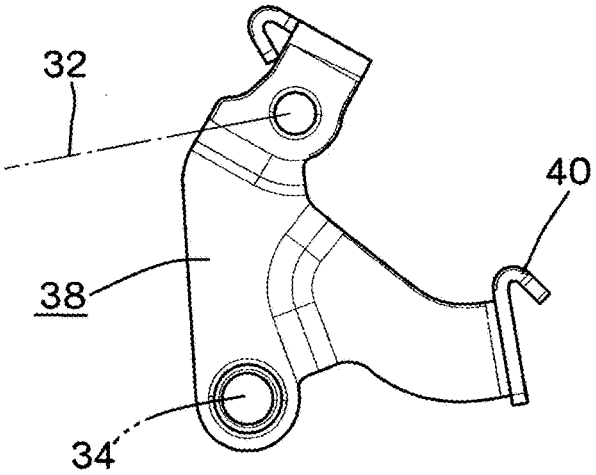
FIG. 10 is a side view of an inner lever.

Child lever 29 blocks a transmission route of door opening operation force of inner open handle 30 toward open link 27 (outer lever 28) to thereby attain the childproof. Inner lever 33 (refer to FIG. 10) that is connected to inner open handle 30 by cable 32 is supported on a lower side of housing case 24 by shaft 34.

On the right side of inner lever 33, slider storage lever 35 (refer to FIG. 11) is pivotably secured to housing case 24 by shaft 36, slide member 37 is mounted on slider storage lever 35 so as to be slidable in the length direction thereof. Pin 39 that faces arc hole 38 of child lever 29 is provided on an end of slide member 37. When child lever 29 rotates, slide member 37 slides in the length direction so as to separate from shaft 36.

Figure 11:
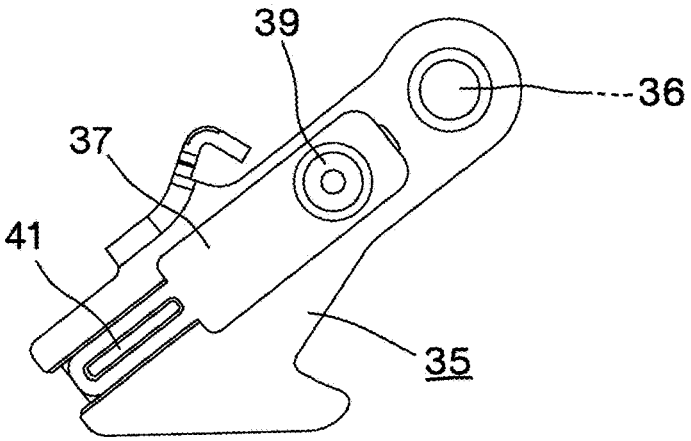
FIG. 11 is a side view of a slider storage lever.

When the childproof mechanism is unset, slide member 37 is stored in slider storage lever 35 as illustrated in FIG. 11. In this state, when inner lever 33 rotates counterclockwise by operation of inner open handle 30, arm 40 of inner lever 33 abuts against protrusion 41 formed on a leading end rear side of slide member 37, so that slide member 37 and slider storage lever 35 are integrally rotated around shaft 36. Then, slider storage lever 35 abuts against outer lever 28 to move open link 27 upward. Consequently, when lock lever 10 is unlocked, door opening is performed.

On the other hand, when child lever 29 rotates clockwise around lock shaft 12, the childproof mechanism is set. In this state, the clockwise rotation of child lever 29 causes pin 39 and arc hole 38 to abut against each other, and thereby slide member 37 is pushed out in the direction away from shaft 36. Therefore, even when inner lever 33 rotates counterclockwise, arm 40 of inner lever 33 cannot be engaged with protrusion 41 of slide member 37, and idly rotates. As a result, slide member 37 and slider storage lever 35 do not rotate, open link 27 does not move upward, and door opening is not performed.

As described above, the childproof mechanism according to the present disclosure has a rational design in that child lever 29 is supported by lock shaft 12 which also supports lock lever 10. Operating force of inner lever 33 that rotates in cooperation with inner open handle 30 is transmitted to slider storage lever 35 through slide member 37, and slide member 37 is slidably mounted on slider storage lever 35. Consequently, slider storage lever 35 and slide member 37 have a structure for rotating around common shaft 36, and are more rationally designed.

What is claimed is:

1. A vehicle door latch device comprising:

a lock lever that is pivotably secured to a housing case with a lock shaft;

an abutting pin that is provided in said lock lever;

a spring support shaft that is provided in said housing case; and an over-center spring having a coil part that is loosely inserted on said spring support shaft, and a base end side spring leg part and a leading end side spring leg part that extend in a direction away from said coil part, elastically hold said abutting pin therebetween, and are paired, wherein the base end side spring leg part and the leading end side spring leg part are in contact with one side of the abutting pin and an opposite side thereto of the abutting pin, respectively, said lock lever is provided with a slot through which said spring support shaft passes, and said lock lever and said spring support shaft are disposed to be superposed on each other in an axial direction of said spring support shaft.

2. The vehicle door latch device according to claim 1, wherein said slot is formed in an arc shape with said lock shaft as a center.

3. The vehicle door latch device according to claim 1, wherein a child lever that is switched between a childproof set position and a childproof unset position is pivotably secured to said lock shaft.

* * * * *